US006460933B1

(12) United States Patent
Bors et al.

(10) Patent No.: US 6,460,933 B1
(45) Date of Patent: Oct. 8, 2002

(54) MULTIPLY ADJUSTABLE LOW BACK SUPPORT ASSEMBLY FOR A WHEELCHAIR

(75) Inventors: Mark S. Bors, Elyria; Lauren M. Boulware, Westlake, both of OH (US); Judy A. Rowley, Kitchner (CA)

(73) Assignee: Invacare Corporation, Elyria, OH (US)

( * ) Notice: Subject to any disclaimer, the term of this patent is extended or adjusted under 35 U.S.C. 154(b) by 0 days.

(21) Appl. No.: 09/514,456

(22) Filed: Feb. 28, 2000

(51) Int. Cl.[7] ..... A47C 7/00

(52) U.S. Cl. ..... 297/440.2; 297/284.9; 297/452.4

(58) Field of Search ..... 297/440.2, 452.4, 297/284.9

(56) References Cited

U.S. PATENT DOCUMENTS

| | | | | | |
|---|---|---|---|---|---|
| 3,854,774 | A | * | 12/1974 | Limpach | 297/423.27 |
| 4,073,537 | A | * | 2/1978 | Hammersburg | 297/464 |
| 4,702,448 | A | * | 10/1987 | LoJacono et al. | 248/227.3 |
| 4,753,482 | A | * | 6/1988 | Warren | 297/452.26 |
| 5,035,467 | A | * | 7/1991 | Axelson et al. | 297/440.22 |
| 5,127,709 | A | * | 7/1992 | Rubinstein et al. | 297/440.2 |
| 5,209,509 | A | * | 5/1993 | Gay et al. | 280/304.1 |
| 5,364,162 | A | * | 11/1994 | Bar et al. | 297/284.8 |
| 5,407,248 | A | * | 4/1995 | Jay et al. | 297/284.1 |
| 5,607,202 | A | * | 3/1997 | Toso et al. | 297/44 |
| 5,848,824 | A | | 12/1998 | Mocur | |
| 5,971,417 | A | | 10/1999 | Swisshelm et al. | |
| 6,095,611 | A | * | 8/2000 | Bar et al. | 297/440.21 |

FOREIGN PATENT DOCUMENTS

| | | |
|---|---|---|
| CA | 1198232 | 12/1985 |
| DE | 198 37 843 A 1 | 2/2000 |
| EP | 0 020 137 | 5/1980 |
| WO | WO 95/07678 | 3/1995 |
| WO | WO 99/17636 | 4/1999 |

* cited by examiner

*Primary Examiner*—Peter M. Cuomo
*Assistant Examiner*—Joseph Edell
(74) *Attorney, Agent, or Firm*—Hudak & Shunk Co., L.P.A.; Laura F. Shunk

(57) ABSTRACT

A wheelchair back assembly is provided which has a back plate held in position relative to upright wheelchair cane members by opposed independent mounting assemblies. The mounting assemblies include a support bar which carries a bracket attached to the back support plate. The assemblies further include universal cane clamp members hingedly attached to a pivot mechanism that allows for independent bi-lateral adjustment in a direction transverse to the longitudinal axis of the seat of the wheelchair. The clamping member further includes a through bore, which is seated on the spindle of a compression latch secured to the upright canes of a wheelchair. A pivotable lever acts as a latch member as it compresses elastomeric O-rings in order to latch the hinge in position relative to the spindle member and to provide for a resilient attachment. The lever also has a locking position to retain the lever in its latched position. The plate is further provided with lateral stabilizer members, which are adjustable in and out. It is provided as well as with a cushion and modesty shroud.

26 Claims, 4 Drawing Sheets

MULTIPLY ADJUSTABLE LOW BACK SUPPORT ASSEMBLY FOR A WHEELCHAIR

The invention relates generally to a back support assembly for use with a wheelchair. More particularly, the invention relates to a support assembly which allows for adjustability of the back support with respect to cane diameter, chair width, seat depth, back angle, and even the transverse angle of the back support with respect to the seat to compensate for spinal rotation or curvature. In particular, the assembly is designed for active wheelchair use where the user desires only low back support. The support assembly is unobtrusive and has an attractive minimalist aesthetic. Adjustable pelvic stabilizers provide further lateral support for active wheelchair use. This type of use is further enabled by a back member, which provides for independent flexibility to absorb bilateral forces.

Moreover, the mounting hardware of the back assembly has a quick-release mechanism, which allows for ease of disassembly and assembly with the chair frame for storage and/or transportation. In particular, the quick release mechanism is provided by opposing cane clamps having a bushing that is engaged by a compression latch having a flippable handle. The cane clamps remain locked in position but flipping the handles releases the latch to permit the back support to be disengaged and removed without altering the desired configuration of the wheelchair back support which has been set by a seating specialist.

BACKGROUND OF THE INVENTION

Very early in the history of wheelchairs, relatively little attention was paid to the seating and positioning provided to benefit a wheelchair user. However, as the health care industry has differentiated products to meet varying user needs, development work has focused on seating and support.

The present invention focuses on the provision of a lower back support for active users. This support is designed for firm but resilient support where it is needed, while providing only minimal interference with the movement of the user's torso. Further, this support assembly inherently provides a range of adjustability in various dimensions but has bilateral mounting hardware that permits the components to be independently positioned and then locked into place.

Moreover, the back assembly in accordance with the invention can easily be tailored to the needs of an individual user and to accommodate various wheelchair frames, although the product has relatively low inventory requirements. The mounting hardware permits the support to be mounted on a variety of widths of wheelchair bases with varying cane diameters and at a variety of heights and angles relative to the seat as well as to the plane defined by the wheelchair canes. The support assembly is provided with lateral support members that also provide for a broad range of adjustability in the width and angle of placement.

The present invention provides a cammed compression latch, which allows convenient but secure mounting to the canes of the wheelchair. When the handle is flipped down into the latched position (i.e., rotated 90 degrees about a horizontal axis pin), it can be slid into a locked position so that it can not inadvertently rotate into the upright removal position. A pull of the latch handle releases the pivot pin from a slot back into a position where the handle can rotate around the camming surfaces provided at the bottom of the handle. This releases the locking mechanism and a simple flip of the handle enables the removal of the back support from the cane clamps. The assembly is also provided with a detachable modesty flap, which unobtrusively shrouds the gap between the seat cushion and the bottom of the back support.

DETAILED DESCRIPTION OF THE INVENTION

Figure 1:
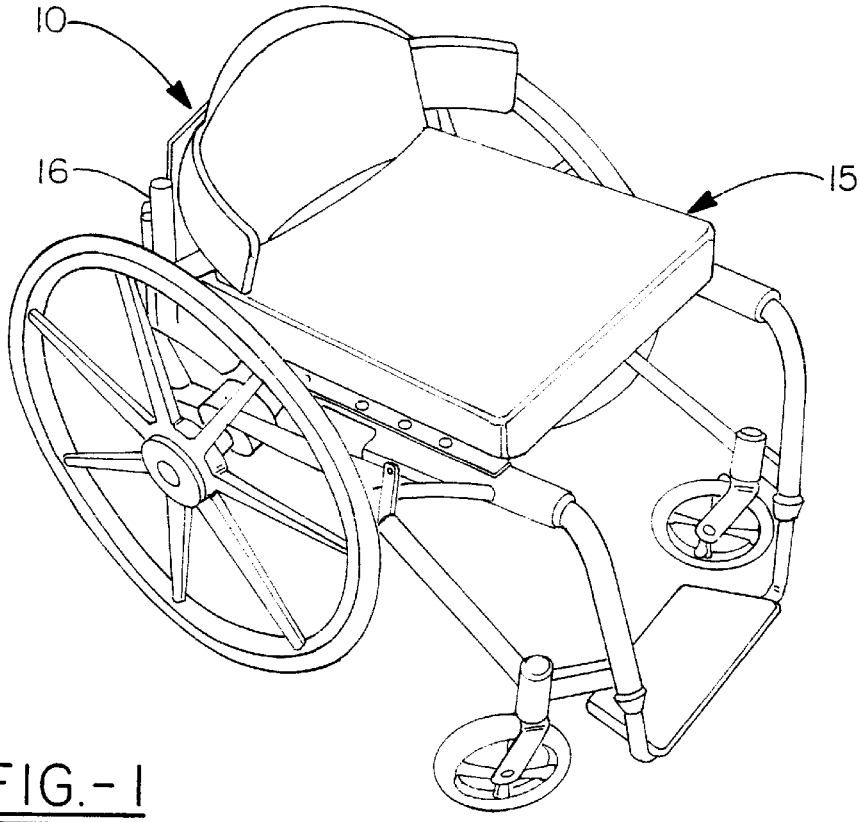
FIG. 1 is a front perspective view of a wheelchair having the back support assembly in accordance with the invention.

In accordance with the invention, a wheelchair back assembly 10 is provided, which includes a low back plate 12, which is supported on each side by means of independent bilateral mounting hardware 14 to the canes 16 of a wheelchair 15. On each side, an L-shaped horizontally extending support bar 20 is captured in a bracket 22. The bracket 22 forms a sleeve portion 23, which can be longitudinally adjusted along the axis of the long leg of the support bar. This provides for width adjustment of the support assembly. The bar 20 could include incremental grooves or markings 38 to gauge the relative position of the bar within the bracket. The bracket can be rotated around the bar to adjust the angle of the plate 12. Screws 34 lock both the angular and the longitudinal position of the bracket relative to the bar member 20. Spacer member 30 maintains the position of the bracket relative to the back plate 12. The plate 12 is relatively rigid and is made from a suitable material, such as plate metal. The plate is provided in three sizes to accommodate wheelchair widths from 14 to 16 inches, 17 to 19 inches, and 20 to 22 inches. Otherwise, the remaining components are standardized so as to provide for custom adjustability with only a minimum of inventory requirements.

Each of the support bars 20 has a short leg 27, which is held in a vertical position approximately parallel to the canes of the wheelchair. Thus, on both sides the mounting assembly provides a stop to prevent the support plate 12 from rotating too far back and unbalancing the user. For each of the mounting assemblies, the bar 20 is fastened at one end to a knuckle 24 which rotates in a clevis 26 to form a hinge 29. The clevis 26 comprises one side of a dog-bone member 25 wherein the second side includes a through-bore 28 that forms a bushing for the spindle 68 of the cane clamp. The hinge 29 provides for adjustment of the angle of the through-bore 28 relative to the bracket 22. Further, the cane clamp assembly 71 can be mounted at an infinite variety of heights and angles circumferentially relative to the longitudinal axis of the wheelchair canes.

Further, on both sides, the plate 12 includes a set of two scalloped slots 40, which enable lateral support members 42 to be mounted in a variety of lateral positions. The support members 42 include two sets of mounting holes to provide for two height choices of each support relative to the set of slots. The mounting screws 41 are necked, or have an inner diameter so as to prove for play within the recesses defined by the slots. This permits the supports to be positioned at a variety of angles in order to accommodate the needs of the user.

Figure 2:
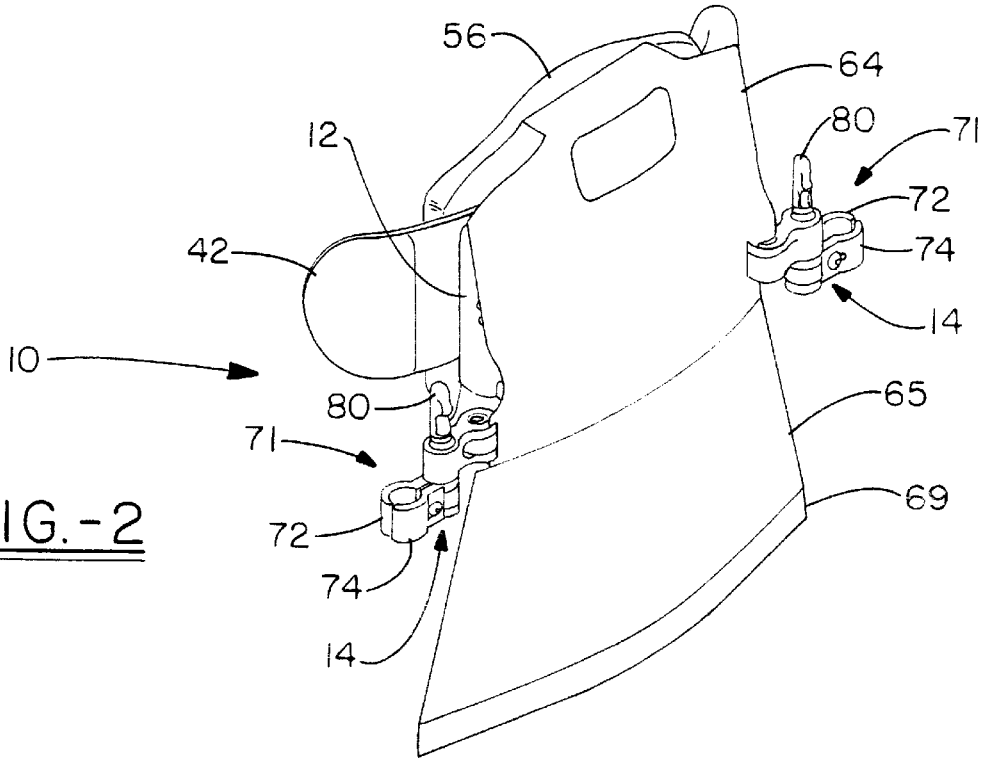
FIG. 2 is a back perspective view of the wheelchair back support assembly in accordance with the present invention.
Figure 3:
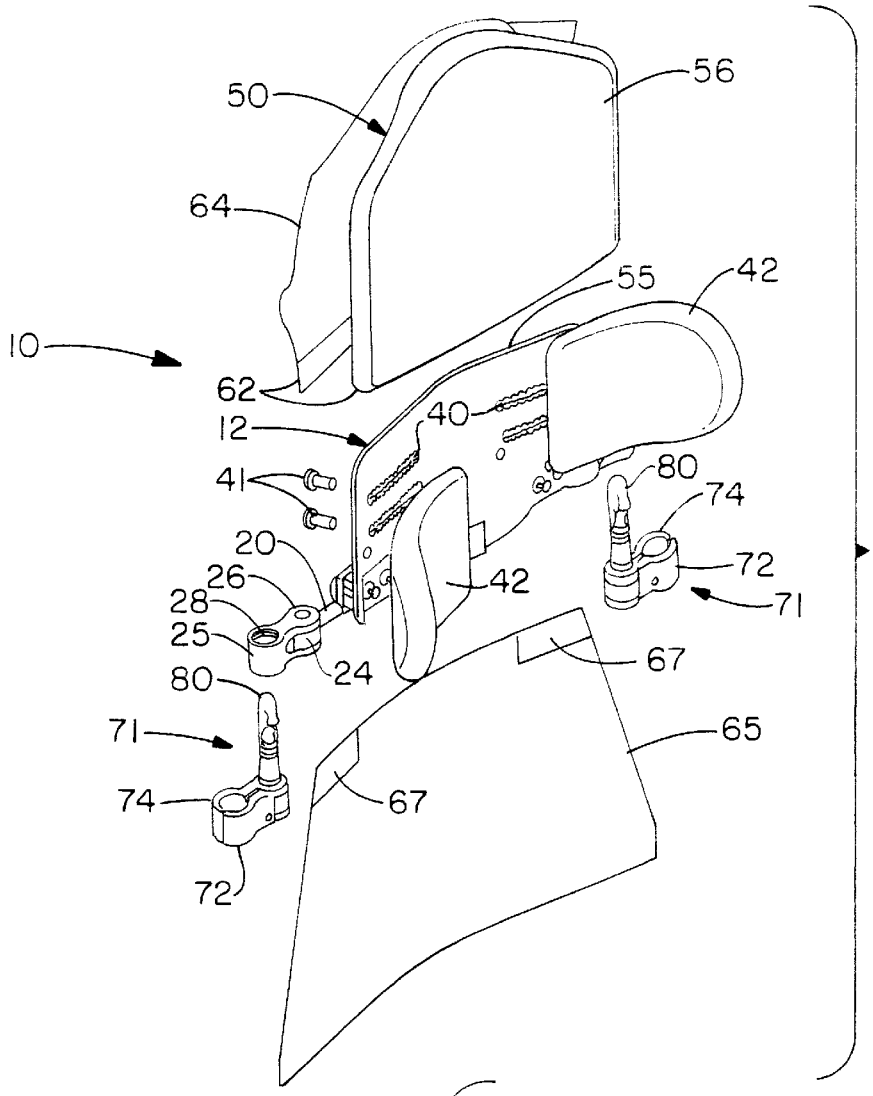
FIG. 3 is an exploded assembly drawing illustrating the back support assembly from a front perspective view.
Figure 4:
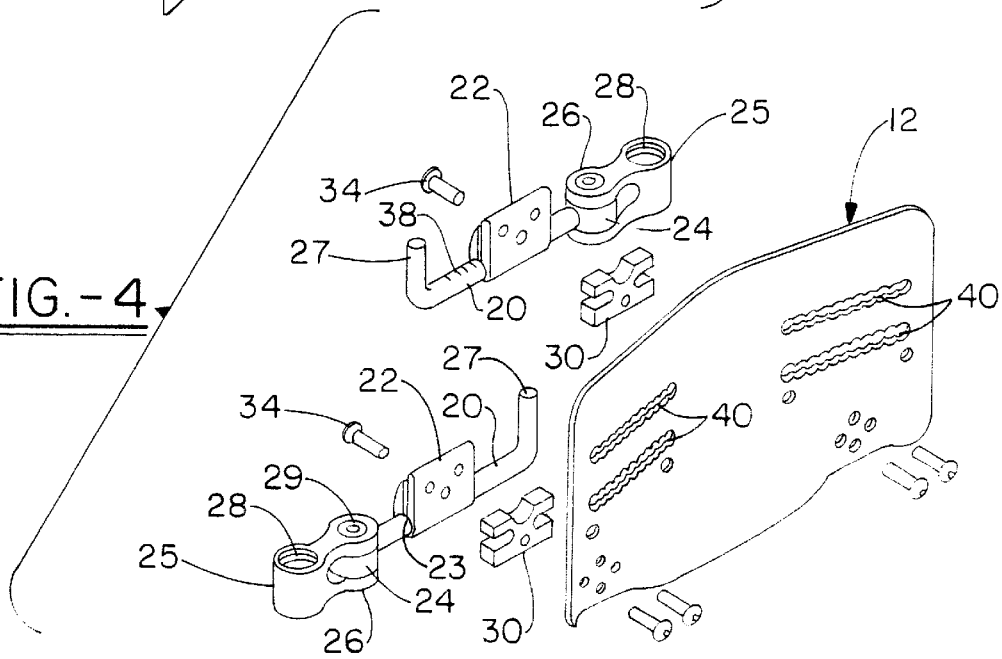
FIG. 4 is a front exploded perspective view of the back support plate and mounting hardware without the cane clamps.
Figure 5:
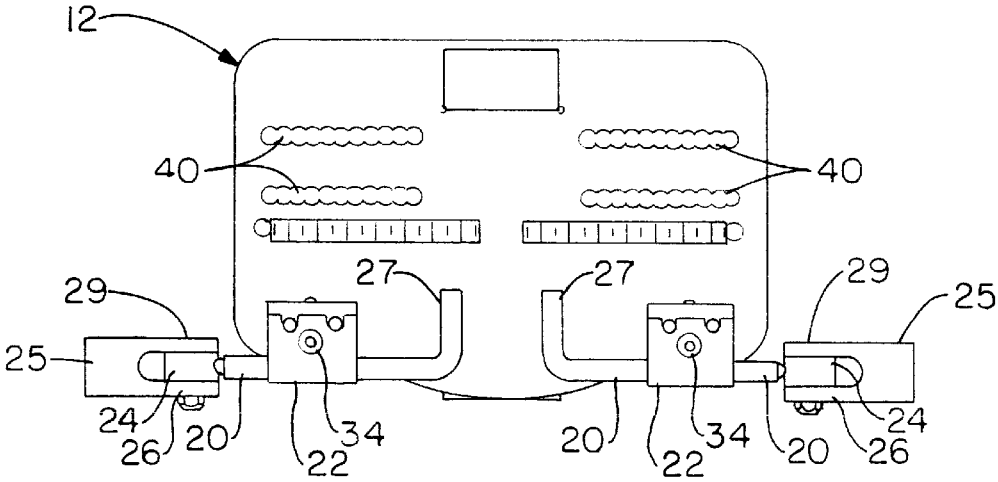
FIG. 5 is a back plan view of the back support plate and mounting hardware.
Figure 6:
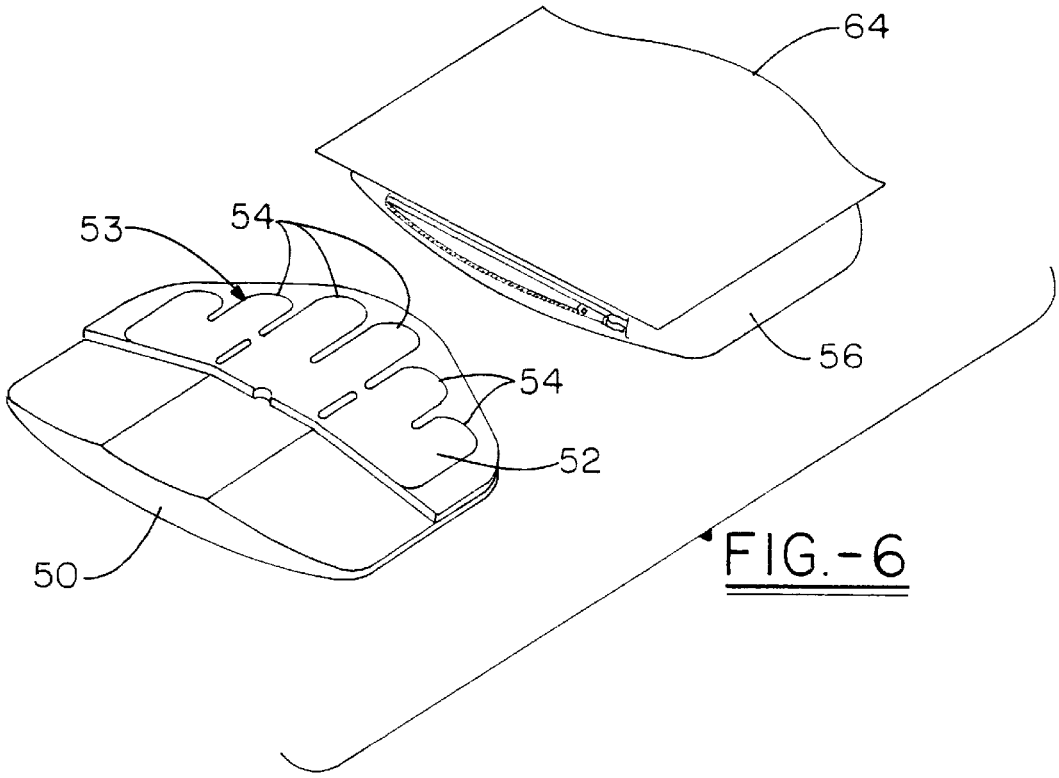
FIG. 6 illustrates the back cushion and cover used with the current invention.

FIG. 6 illustrates the upholstery for the back support which comprises a relatively soft foam cushion 50 having a flexible but relatively rigid rigidizer member 52 made from a thin sheet of polycarbonate and which is scalloped on one end to provide independent lateral flexibility for the back support. The scalloped area 53 defines a series of fingers 54 which are positioned to extend upward beyond the top of the plate 12. These fingers protect the user from encountering the hard edge 55 of the plate 12. Further, the fingers flex independently of each other to avoid concurrent movement of the back support in response to a lateral or torquing force. A cushion cover mounted to wheelchair canes varying at least from ¾ to one inch or slightly larger in diameter. A cushion cover 56 is constructed of an appropriate material and includes a zippered pouch, which envelops the cushion 50 and the low back plate 12. As can be seen in FIGS. 1 and 2, the cover includes a back flap 64 which covers the mounting hardware assemblies but provides side vents 62, which allows the lateral members and mounting hardware to extend beyond the cushion back 50. Also, a modesty flap 65 is provided which is removably secured, such as by hook and loop fasteners 67, to the inside of the rear flap 64. The modesty flap 65 further includes the means 69, such as hook and loop, to secure it to the bottom of the seat cushion. This flap 65 acts to drape the opening between the seat cushion and the bottom of the back support plate. The flap is made from a suitable material such as 600-denier nylon fabric that is heavy enough not to be obtrusive to the user but light enough to drape comfortably. The flap has a trapezoidal shape in order to accommodate a variety of seat widths in correlation with the adjustability of the back support relative to the seat.

Figure 7:
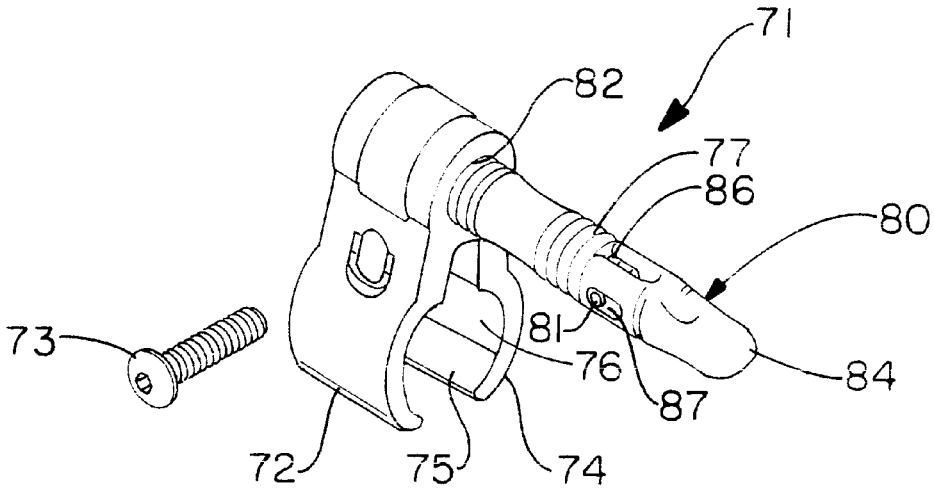
FIG. 7 is top perspective view of the cane clamp and compression latch in an unlocked position.
Figure 8:
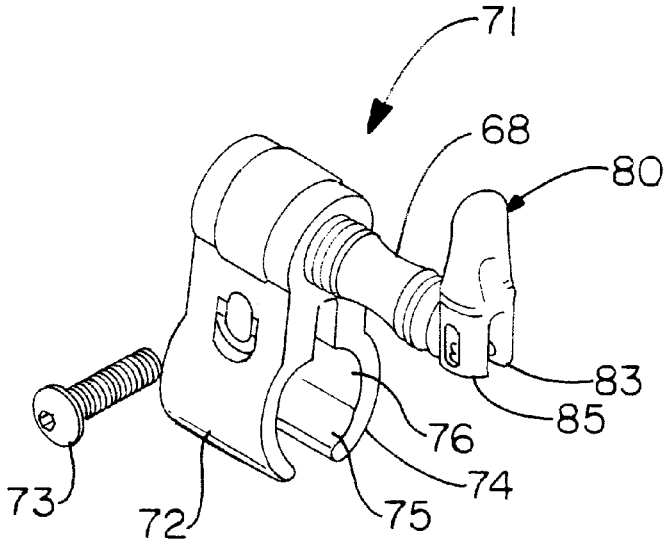
FIG. 8 is a top perspective view of the cane clamp and compression latch in a locked position.

In addition, each of the mounting hardware assemblies includes a universal cane-mounting clamp 71. These clamps are designed to be mounted to the common size diameters of canes. The clamps each have a pair of curved arms 72,74, which together form a C-shape, which embraces the wheelchair canes and which is fastened by means of the screw 73. As can be seen in FIGS. 7 and 8, the curved arms 72,74 have multiple radiused areas to define recesses of differing diameters. In particular, the recess has a first semicircular area 75 with a radius of ⅜ inch and a second semicircular area 76 with a radius of ½ inch. Thus, the clamps can be mounted to wheelchair canes varying at least from ¾ to one inch or slightly larger in diameter.

Cammed compression member 80 extends vertically upward from a bore 82 within an extension of the dog bone member. The compression clamp includes a lever 84, which extends upwardly and has a bottom yoke 83 with a curved camming portion 85. A leg 86 extends upwardly from a spindle 68 of the clamp. The yoke includes a slot 87 pivotably captured on a pin 81 secured to the leg 86. The spindle 68 further includes a resilient O-ring 77 such that when the lever is rotated 90 degrees into a locked position, the O-ring 76 is put into compression so that it expands to hold it in position in tight engagement relative to the through-bore 28 of the hinge member 24. The O-RINGS further provide for resiliency in the mounting hardware which enables the back to provide active support and absorb up to 5 degrees of rotation in and out of recline. The slot 87 allows the lever handle to slide into a locked position with respect to the leg 86. When the lever handle is slid into the locked position, the yoke cannot rotate around the pin but is instead locked into position. The lever handle can be slide back into the latching position in which the pin is at the other end of the slot so that the handle can be rotated to an upright position.

As it can be seen, flipping the levers on each side to an upright position releases the pressure on the O-ring to permit easy disengagement of the back member from the cane clamps. Thus simply sliding and flipping the levers allows for disengagement of the back support for folding of the chair. However, upon re-assembly, the support is easily repositioned into the desired position.

The components enable the quick-release clamp to be slid from the through bore so that the back assembly may be lifted away from the cane clamping mechanism. Upon reassembly, the dogbone member is mounted on the spindle of the swell latch. Subsequently, the lever is slid downward to lock the back member into the appropriate position relative to the seat of the wheelchair. It is preferable to use a compression latch as described by the present invention for the ease of use and economy that it represents. However, the wheelchair back assembly in accordance with the present invention also contemplates the use of other quick-release-clamps including other swell latch mechanisms.

What is claimed is:

1. A back support assembly for mounting to a pair of spaced upright cane members forming part of a wheelchair, said assembly comprising:

a back support having a first side and a second side respectively mounted to a first and a second of said pair of cane members;

two sets of mounting hardware which each includes at least one clamp for one of said canes, said clamps having a pair of curved arms which together define a recess which at least partially surrounds the circumference of said cane and said recess having at least a first semicircular area defined by a first radius and a second semicircular area defined by a second radius whereby said clamp can be mounted on canes of differing diameter.

2. A back support assembly as set forth in claim 1 wherein said clamp is a c-clamp formed of two opposing arm members which can be biased inward to clamp onto said cane.

3. A back support assembly as set forth in claim 2 wherein said clamps can be variably positioned on said canes with respect to height.

4. A back support assembly as set forth in claim 1 wherein said clamps can be variably positioned with respect to a circumferential angle about the longitudinal axis of said cane.

5. A back support assembly as set forth in claim 4 wherein said clamp further includes a spindle member which can be received in a journal in a mounting assembly connected to the back support.

6. A back support assembly as set forth in claim 5 wherein the journal is formed in a dogbone member which further include a hinge.

7. A back support assembly as set forth in claim 6 wherein the hinge is joined to a support bar which carries a bracket fastened to said back support.

8. A back support assembly as set forth in claim 7 wherein the bracket can be variably positioned along the longitudinal axis of said support bar and at a variable angle.

9. A back support assembly for mounting to a pair of spaced upright members forming part of a wheelchair, said assembly comprising:

a back support mounted to said pair of upright members;

mounting hardware which includes at least one clamp having a camming surface which engages an elastic member and a flippable lever member which can be pivoted between a first and second position so as to cause said camming surface to bear against said elastic member to cause it to be compressed and thereby to lock said clamp.

10. A back support assembly as set forth in claim 9 wherein said clamp further includes a camming surface which is engaged when said lever member is pivoted between the first and the second position.

11. A back support assembly as set forth in claim 10 wherein one of said first or said second positions is an upright position.

12. A back support assembly as set forth in claim 11 wherein said upright members are canes of a wheelchair which are located on both lateral sides of a wheelchair seat and wherein said mounting hardware includes one of said clamps for each of said pair of canes.

13. A back support assembly as set forth in claim 12 wherein said mounting hardware includes a first assembly which connects a first side of the back support to a first of said canes and a second assembly which connects a second side of the back support to a second of said canes.

14. A back support assembly as set forth in claim 13 wherein said first and said second mounting assemblies enable the adjustment of the width of the back support assembly.

15. A back support assembly as set forth in claim 13 wherein said first and said second mounting assemblies enable the adjustment of the height of the back support relative to the seat.

16. A back support assembly as set forth in claim 13 wherein said first and said second mounting assemblies independently enable the adjustment of the angle of the back support member relative to the canes.

17. A back support assembly as set forth in claim 13 wherein said first and said second mounting assemblies each include a c-clamp which can be variably positioned on said canes.

18. A back support assembly as set forth in claim 17 wherein said c-clamp can be mounted on multiple cane members having a variety of diameters.

19. A back support assembly as set forth in claim 18 wherein said c-clamp has opposing members which together define a recess to receive said cane and said recess has at least a first area defined by a first radius and a second area defined by a second radius.

20. A back support assembly as set forth in claim 17 wherein said first and second mounting assemblies include a pivotably variable hinge member which is connected to a support member operatively connected to a side of the back support member.

21. A back support assembly as set forth in claim 20 wherein said hinge includes a bore which receives a spindle attached to a latch and supported by said c-clamp on said cane.

22. A back support assembly as set forth in claim 21 wherein said latch includes said lever which is activated by pivoting to secure said spindle in said bore.

23. A back support assembly as set forth in claim 22 wherein said lever pivots about a pin and the lever can be locked by sliding it relative to the pin.

24. A back support assembly as set forth in claim 9 wherein said mounting hardware includes at least one cane clamp having a compression member.

25. A back support assembly for mounting to a pair of wheelchair canes, said assembly comprising:

a back support mounted on either side by a bracket to a respective one of said wheelchair canes, said bracket each having a bore held by mounting hardware which resiliently secures said back support to said pair of canes, said mounting hardware including two cane clamps which each have a spindle received by a bore and a lever that radially expands an elastic compression member to lock the spindle in the bore.

26. A back support assembly as set forth in claim 25 wherein said compression member is an elastomeric O-ring.

* * * * *